United States Patent [19]

McCleerey

[11] Patent Number: 5,041,009

[45] Date of Patent: Aug. 20, 1991

[54] DAISY CHAIN CONNECTOR AND METHOD

[75] Inventor: Earl W. McCleerey, Mechanicsburg, Pa.

[73] Assignee: AMP Incorporated, Harrisburg, Pa.

[21] Appl. No.: 529,773

[22] Filed: May 29, 1990

Related U.S. Application Data

[63] Continuation of Ser. No. 237,245, Aug. 26, 1988, abandoned, which is a continuation-in-part of Ser. No. 90,296, Aug. 31, 1987, Pat. No. 4,781,615.

[51] Int. Cl.[5] ..... H01R 4/24

[52] U.S. Cl. ..... 439/405; 439/494; 439/417

[58] Field of Search ..... 439/395–407, 439/391, 392, 492–499; 29/861, 866

[56] References Cited

U.S. PATENT DOCUMENTS

| | | | |
|---|---|---|---|
| Re. 32,439 | 6/1987 | Narozny . | |
| 3,824,530 | 7/1974 | Roberts et al. | 439/398 |
| 3,963,300 | 6/1976 | Patton et al. | 339/156 R |
| 4,062,616 | 12/1977 | Shaffer et al. . | |
| 4,068,912 | 1/1978 | Hudson, Jr. et al. . | |
| 4,143,935 | 3/1979 | Goodman et al. . | |
| 4,241,970 | 12/1980 | Rider, Jr. et al. . | |
| 4,310,208 | 1/1982 | Webster et al. . | |
| 4,327,956 | 5/1982 | Sitzler | 439/397 |
| 4,410,229 | 10/1983 | Stephenson . | |
| 4,508,401 | 4/1985 | Casciotti et al. | 29/861 |
| 4,668,039 | 5/1987 | Marzili . | |
| 4,671,596 | 6/1987 | Soma | 439/404 |
| 4,679,880 | 7/1987 | Pitsch | 439/404 |
| 4,737,117 | 4/1988 | Lockard | 439/494 |
| 4,752,238 | 6/1988 | Nakamura et al. | 439/399 |
| 4,773,876 | 9/1988 | Nakamura et al. | 439/417 |
| 4,781,615 | 11/1988 | Davis et al. . | |
| 4,834,674 | 5/1989 | Beamenderfer et al. | 439/494 |

FOREIGN PATENT DOCUMENTS 61-074100 3/1986 Japan .

OTHER PUBLICATIONS

European Search Report.
Annex to European Search Report.

*Primary Examiner*—David L. Pirlot
*Attorney, Agent, or Firm*—David L. Smith

[57] ABSTRACT

A daisy chain connector (10) and method of using the connector (10) are disclosed. The connector has a housing having contacts (16) secured therein. A pair of terminating covers (56,58) are provided for applying termination force to conductors (48) of a multiconductor round or flat cable (46). The conductors (48) are formed into two loops with the connector therebetween. A terminating cover (56,58) is positioned in each loop (52,54), the conductors are positioned relative to the covers (56,58) then the covers (56,58) are pressed toward each other terminating the conductors to insulation displacement portions of the contacts (16) and simultaneously securing the covers (56,58) to the connector housing (20).

4 Claims, 6 Drawing Sheets

DAISY CHAIN CONNECTOR AND METHOD

This application is a continuation of application Ser. No. 237,245 filed Aug. 26, 1988, now abandoned, which was a continuation-in-part application of application Ser. No. 090,296 filed Aug. 31, 1987, now U.S. Pat. No. 4,781,615.

BACKGROUND OF THE INVENTION

The present invention relates to providing a method as well as a pin and socket connector capable of providing a connector in a daisy chain configuration on a cable and, in particular, to a method as well as a pin and socket connector capable of terminating either conductors of a multiconductor flat cable, or conductors of a multiple conductor round cable, to the pin and socket type connector in a daisy chain configuration.

Connectors for terminating a flat ribbon cable in a daisy chain configuration are known. Typical connectors for terminating a ribbon style cable in a daisy chain configuration are shown in U.S. Pat. Nos. 4,068,912, 4,410,229 and 4,668,039. These connectors are designed to terminate ribbon cable to a connector having receptacle contacts for reception on a corresponding array of square posts.

A pin and socket connector is disclosed in U.S. Pat. Nos. 4,062,616, 4,241,970 and RE 32,439 capable of terminating a flat ribbon cable in a daisy chain configuration. These patents disclose connectors having contacts that terminate to a single array of conductors which permits a ribbon cable to be terminated to contacts secured in the connector, then pass through the connector to continue in the daisy chain configuration. High density connectors, such as the AMPLIMITE 0.050 Series connector sold by the assignee, typically have contacts with insulation displacement cable terminating sections in two, oppositely-facing arrays which do not permit terminating a ribbon cable in the manner of the connectors disclosed in the above patents.

A ribbon cable may be folded over with the conductors of the cable terminated to two arrays of contacts. A first portion of the conductors of a cable is terminated in staggered terminals on a first level and the remaining conductors are terminated to spaced contacts on a second level, as taught by U.S. Pat. No. 4,143,935. This approach, however, is not suited to daisy chain applications as it does not permit the cable to be received from a previous connector in the daisy chain configuration at a first side of a terminating connector and pass from a second side of the terminating connector to a subsequent connector in the daisy chain configuration. Furthermore, another problem is introduced: the pin assignments between the cable conductor and contacts is very limited and may not be consistent, depending upon how the conductors of the folded cable are oriented with respect to the two levels of contacts at each connector.

SUMMARY OF THE INVENTION

The insulation that interconnects conductors of a ribbon cable is split, parallel to the axis of the conductors, midway between conductors for a limited length along the cable. Alternate conductors or groups of conductors, as split out of the cable, are formed into a first loop, with the remaining alternate conductors or groups of conductors, as split out of the cable, formed into a second loop. A connector housing having two arrays of insulation displacing contacts is positioned between the conductors forming the two loops with the insulation displacing portion of the contacts oriented to terminate to the conductors forming the loops. A cable terminating cover is inserted through each of the first and second loops of conductors. The conductors are positioned in respective fluted recesses in a respective cable terminating cover in accordance with a desired conductor-to-contact relationship. The cable terminating covers are positioned with interengaging legs facing each other. The conductors are terminated to the insulation displacing portion of the contacts in the connector housing by pressing the cable terminating covers together. Strain relief may be provided.

DESCRIPTION OF THE PREFERRED EMBODIMENT

Figure 1:
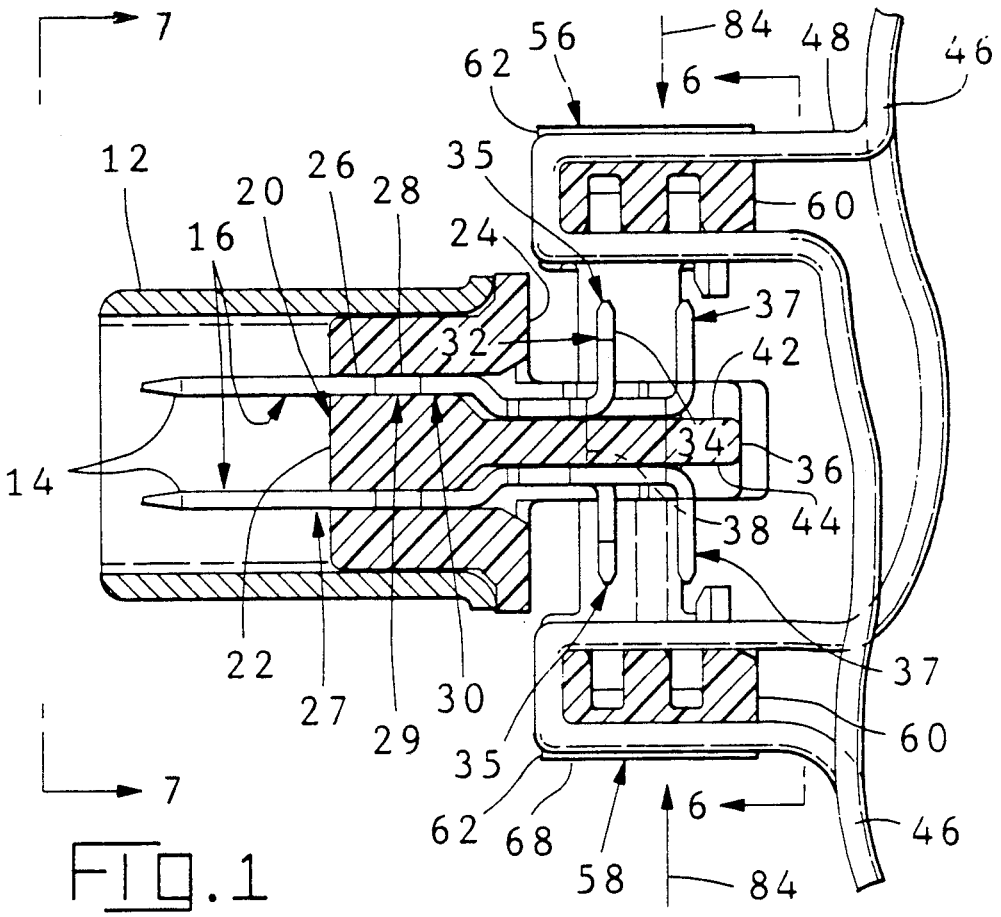
FIG. 1 is a side sectional view of a connector with backshell and backshell cover removed in accordance with the present invention, positioned to be terminated on a ribbon cable or round cable.
Figure 2:
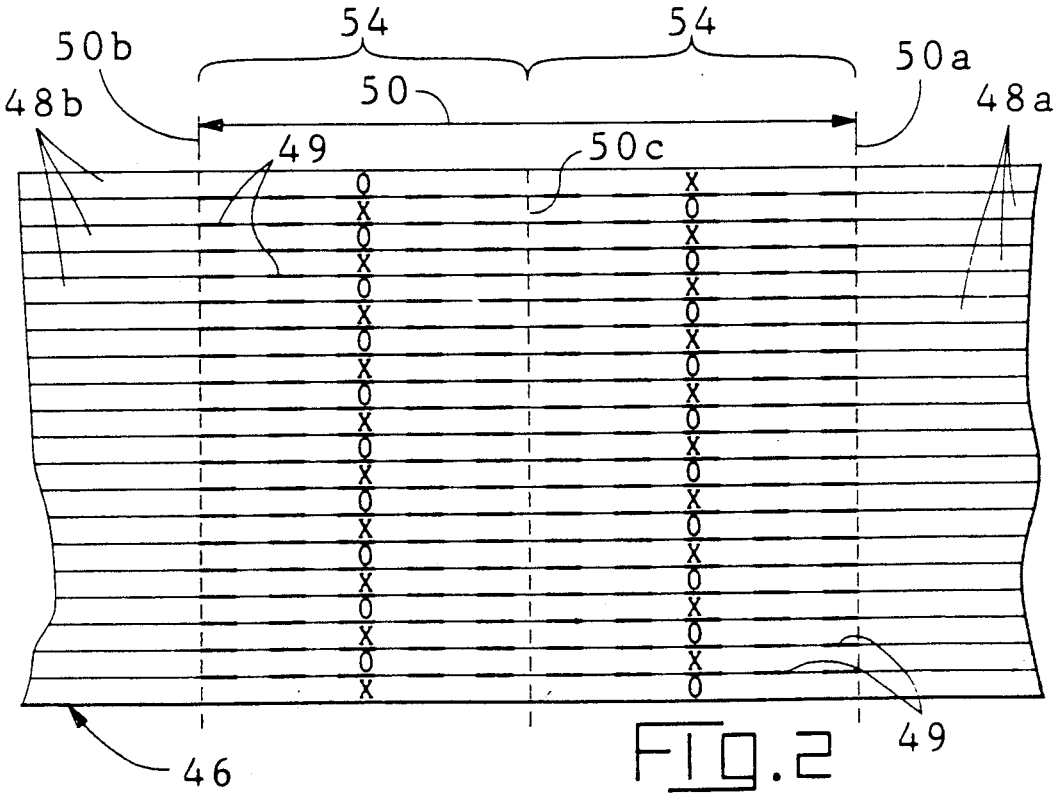
FIG. 2 is a plan view of a ribbon cable showing how the conductors are split out to form the loops required for daisy chain termination.

FIG. 1 depicts a side sectional view of an electrical connector 10 having two arrays of insulation displacement contacts capable of terminating conductors of a multiple conductor cable to a pin or socket type connector in a daisy chain configuration in accordance with the present invention. Connector 10 is an improvement over the connector disclosed in U.S. Pat. No. 4,781,615, which is hereby incorporated by reference. The preferred embodiment shows a shielded plug connector, however, the invention has application to other connectors such as unshielded connectors and receptacle connectors. Drawn shell 12 shields tabs 14 of contact 16 and engages shielding of a complementary connector when mated thereto.

Elongate housing 20 is molded of thermoplastic material having a mating face 22 and opposing rear face 24 and a plurality of contact receiving passages 26 extending therebetween. Mating face 22 may provide a polarization feature by having a trapezoidal or subminiature-D shape. Shell 12 surrounds mating face 22 and conforms to the shape of housing 20. Shell 12 extends forward of mating face 22 and provides shielding for contacts 16. Contact receiving passages 26 are arranged in two rows 27,29 and have contacts 16 secured therein. Contacts 16 are secured in contact receiving passages 26 by barbs 28 which plow through the sidewalls of contact receiving passages 26 upon insertion of contact 16, thereby securing contacts 16 by an interference fit.

Contact 16 includes central body portion 30 securingly received in contact receiving passages 26, with a mating portion, shown in the preferred embodiment as tab 14, extending from a first side thereof. A terminating portion 32 extends from another side of body portion 30 and has on its free end a slotted insulation displacing plate 34 as is known in the art. Due to the relatively small size of connector 10 relative to the centerline spacing of contacts 16, adjacent contacts 16 in each row 27,29 have terminating portions 32 of different lengths to provide space for insulation displacing plates 34 with the result that insulation displacing plates 34 form two rows 35,37 on each side of terminal support block 36.

Terminal support block 36 extends rearward from rear face 24 between the two rows 27,29 of contact receiving passages 26 at least as far as terminating portions 32, defining surfaces 42,44 and having apertures 38 (see FIG. 6) at opposite ends thereof. Apertures 38 have axes that are parallel with insulation displacing plates 34. Insulation displacing plates 34 in rows 27 and 29 have conductor receiving slots 40 that are opposed and open facing away from surfaces 42,44. During termination of conductors 48 to contacts 16, insulation displacing plates 34 bear on respective surfaces 42,44 of block 36.

An electrical connector 10 in accordance with the present invention may be terminated to either multiple conductor ribbon cable or multiple conductor round cable. To terminate connector 10 to a multiple conductor jacketed or shielded cable, the jacket 47 or shielding 49 are stripped back or removed through the length of limited segment 50.

Figure 4:
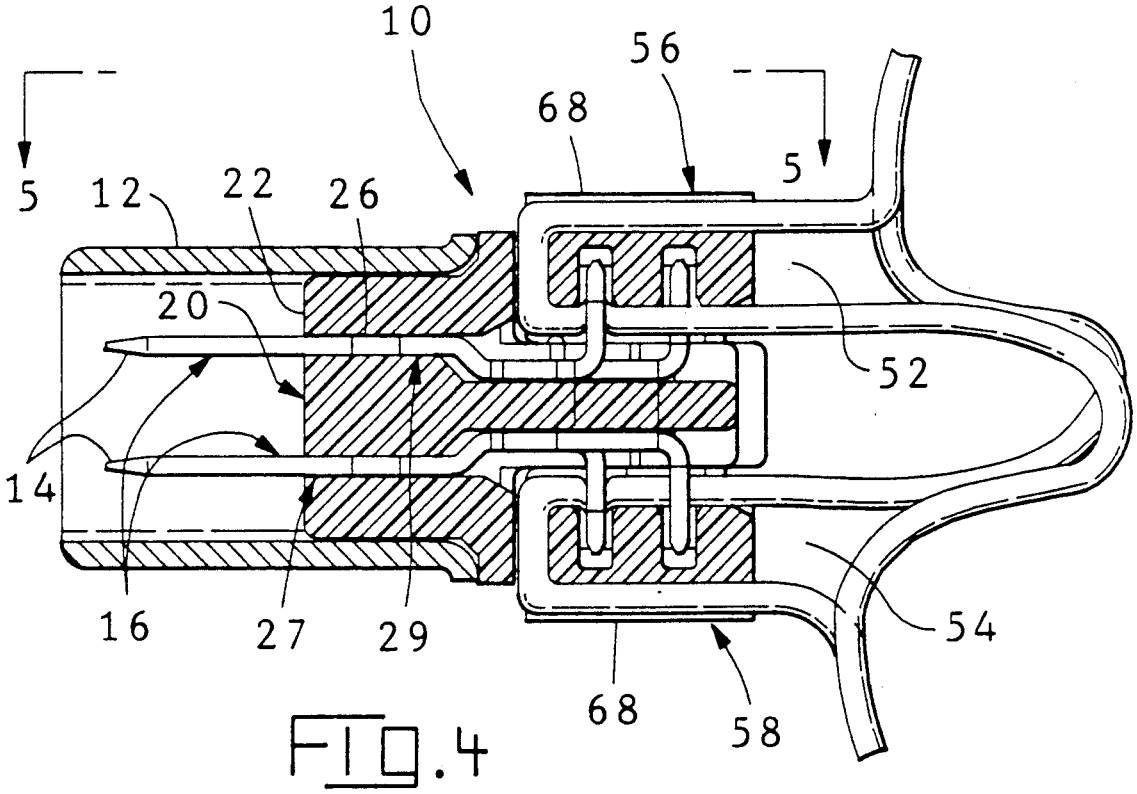
FIG. 4 is a sectional side view of the connector of Figure terminated to the cable in a daisy chain configuration.

To terminate connector 10 to multiple conductor ribbon cable 46 having individual conductors 48 on spaced centerlines, the insulation between adjacent conductors 48 is first split axially along a limited segment 50 of ribbon cable 46, as best seen in FIG. 4. Typically, a split 49 is made between all adjacent conductors 48 so that individual conductors 48 may be terminated to specific contacts 16 thereby permitting a specific conductor-to-contact assignment to be maintained and repeated along the daisy chain configuration. This also permits terminating a ribbon cable 46 having conductors 48 on a first spacing to the insulation displacing plate 34 of contacts 16, the slots 40 of which are of a second spacing that may range from greater than to less than the first spacing.

Figure 3:
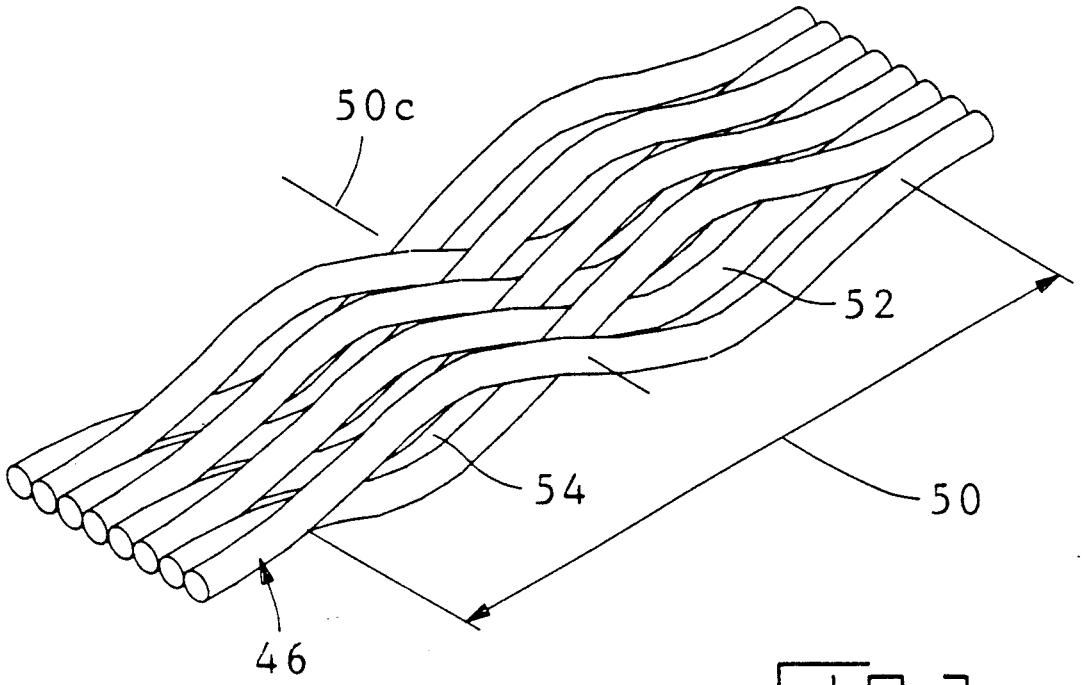
FIG. 3 is a perspective view of the split cable of FIG. 2 having two loops formed therein.

Conductors 48 are formed into two loops as shown in FIG. 3 through the limited segment 50 of cable 46. A first loop 52 of conductors is formed of conductors **48*a* between the centerline 50*c* and end 50*a* of segment 50. A second loop 54 of conductors is formed of conductors 48*b* between the centerline 50c and end 50b of segment 50. Each conductor 48 is typically formed into only one of the two loops 52,54 of conductors; however, a conductor 48 could be formed into each of loops 52 and 54 and terminated on a contact 16 in each row of passages 27,29, thus being terminated on both sides of connector 10** or not terminated on a particular connector thus bypassing it to be terminated on another connector in a daisy chain configuration.

In a preferred embodiment, every other conductor 48 is formed into loop 52 with the alternate conductors 48 formed into loop 54. The preferred embodiment thus provides a very convenient method of terminating ribbon cable with conductors of a first spacing to contacts having insulation displacing slots of a second spacing where the spacing of the contacts 16 is twice as great as the spacing of conductors 48 in ribbon cable 46. Thus, as shown in FIG. 4, conductors **48*a* are formed into loop 52 and conductors 48*b* are formed into loop 54. As conductors 48 are moved out of the plane of ribbon cable 46, the non-split portions of ribbon cable 46 are pulled, axially along the conductors, to be closer together. The end result and loops 52,54 are best seen in FIG. 1 with cable terminating covers 56,58 in a pretermination position, and in FIG. 4 with cable terminating covers 56,58** in a terminated position.

Any combination of dividing the conductors of a multiple conductor cable into a first group of conductors to form a first loop and a second group of conductors to form a second loop such that the conductors can continue in a daisy chain configuration with a predetermined conductor-to-contact assignment or a dressing are contemplated within the scope of the invention. Although the preferred embodiment discloses forming every other conductor into a first loop and the alternate conductors into a second loop, the invention is not limited thereto. For example, in going across a ten conductor cable, the first, third, fourth, ninth and tenth conductors may be formed into a first loop while the remaining conductors are formed into a second loop.

With conductors 48 of a ribbon cable split out or with the outer jacket 47 removed from a round multiple conductor cable, conductor-to-contact assignments are very flexible providing a wide range of possible conductor-to-contact assignments. Although in a ribbon cable application the first conductor 48 in a transverse path across the ribbon cable is terminated to the first contact 16 in a transverse path across the row 29 of contacts across a surface 42 of terminal support block 36, the third conductor 48 in the transverse path across the ribbon cable (second conductor 48 in loop 52) is terminated to the second contact 16 in a transverse path across the row of contacts across a surface 42 of terminal support block 36, the fifth conductor 48 in the transverse path across the ribbon cable (third conductor in loop 52) is terminated to the third contact 16 in a transverse path across the row of contacts across a surface 42 of terminal support block 36, etc. The invention is not limited thereto. Any conductor-to-contact assignment is contemplated within the invention. The use of a round cable with color coded insulation on the individual conductors may have some advantage in more complex conductor-to-contact assignments due to the ease of identifying conductors by the color code. The conductors of a twisted pair cable can be terminated maintaining the two conductors of a twisted pair on adjacent contacts.

With loops 52 and 54 formed, cable terminating covers 56,58 respectively are passed axially into loops 52 and 54 of conductors 48, and positioned to terminate conductors 48, as shown in FIG. 1. Conductors 48 may be fanned out into an organized configuration that may be replicated in the daisy chain application. The conductors may be maintained in the configuration at desired spacings by any known method such as an adhesive strip, heat bonding or chemical bonding of the insulation, or by tooling. Alternatively, conductors 48 of loops 52,54 may be individually positioned relative to an insulation displacing plate 34 for termination.

Figure 5:
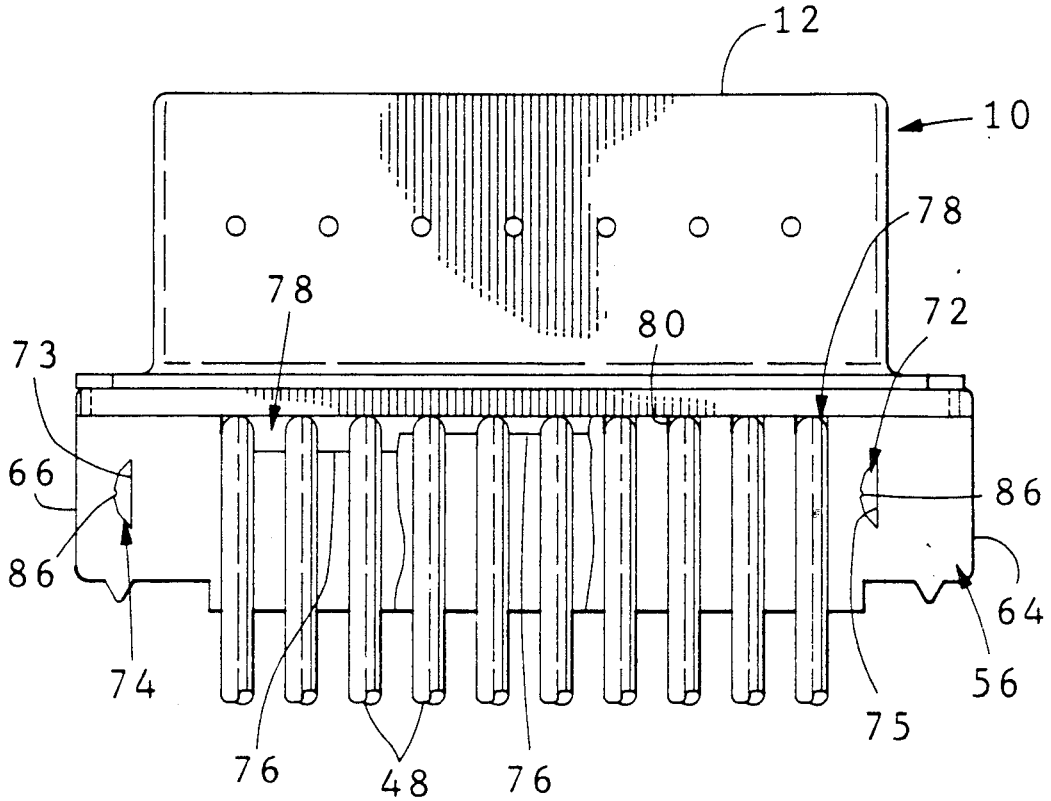
FIG. 5 is a side view of the connector of FIG. 4 taken along lines 5—5.

Cable terminating covers 56,58 may be substantially as disclosed in U.S. Pat. No. 4,781,615. Cable terminating covers 56,58 are elongate having sidewalls 60,62 opposed end walls 64,66, outer surface 68 and inner surface 70, a portion of which may be fluted. Leg means 72,74 extend from inner surface 70 proximate endwalls 64,66, and have aperture means 73,75 adjacent thereto. Cable terminating covers 56,58, which may be hermaphroditic, have a recess 76 on one of sidewalls 60,62 that defines a conductor receiving passage 78 which permits conductors 48 to pass between cable terminating covers 56,58, more specifically recess 76, and rear face 24 to continue in the daisy chain configuration. Conductors 64 turn 90 degrees from passing along surface 70 where they are terminated to pass through passage 78 which extends perpendicular to surface 70 and parallel to insulating displacing plates 34. In the preferred embodiment, passage 78 takes the form of notches 80 to aid in positioning and maintaining conductors 48 prior to, during and subsequent to termination. Passage 78 may take other forms such as a single wide recess for all conductors or a recess with individual notches per conductor, as shown in FIG. 5.

Figure 6:
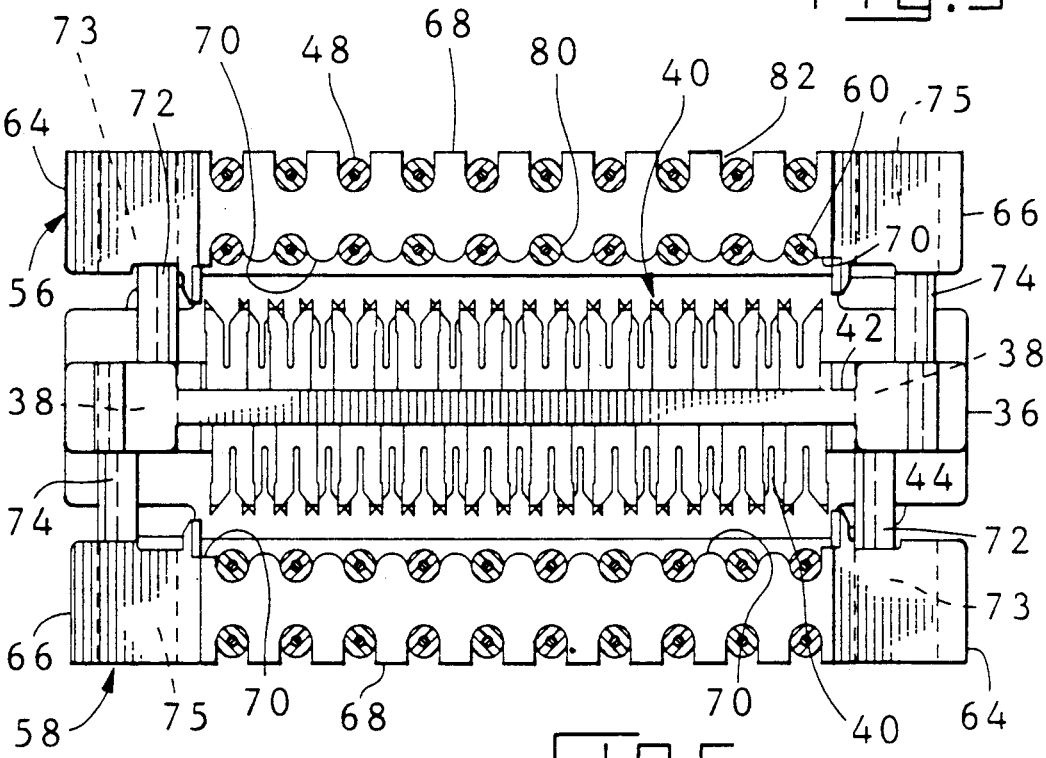
FIG. 6 is a bottom end view of the connector of FIG. 1 taken along lines 6—6.

Conductors 48 are positioned in notch 80, as seen in FIG. 6, for an insulation displacement termination. Cable terminating covers 56,58 may also have channels 82 in outer surface 68 to provide a recess for conductors 48. In this manner, outer surface 68 of terminating covers 56,58 provides a bearing surface on which force is applied to terminate conductors 48 to contacts 16. Notches 80 provide an avenue for conductors 48 to egress from between terminating covers 56,58 and terminal support block 36 as well as from between terminating covers 56,58 and rear face 24 so that conductors 48 may continue in the daisy chain configuration. Conductors 48 passing between terminating covers 56,58 and terminal support block 36 provide strain relief to the termination.

Leg means 72,74 provide means for securing terminating covers 56,58 to terminal support block 36 and thus to connector 10. Complementary shaped leg means 72,74 on inner surface 70 of terminating covers 56,58 respectively are axially aligned with apertures 38 as best seen in FIG. 1. Thence, terminating covers 56,58 are moved toward terminal support block 36 in the direction of arrows 84 with legs means 72,74 passing into apertures 38 in an interference fit, thence into aperture means 73,75 in the other terminating cover. As the terminating covers 56,58 are pressed toward each other until seated against respective surfaces 42,44 of terminal support block 36, conductors 48 are terminated by respective insulation displacing plates 34 in both rows of contacts 16. Leg means 72,74 engage sidewalls of apertures 38 as well as a protrusion 86 on the walls of aperture means 73,75 in the other terminating cover to secure terminating covers 56,58 in the terminated position.

In this manner, the interference fit between protrusion 86 and leg means 72,74 in the terminated position engages protrusion 86 against a surface of leg means 72,74 respectively that was not previously deformed.

Figure 7:
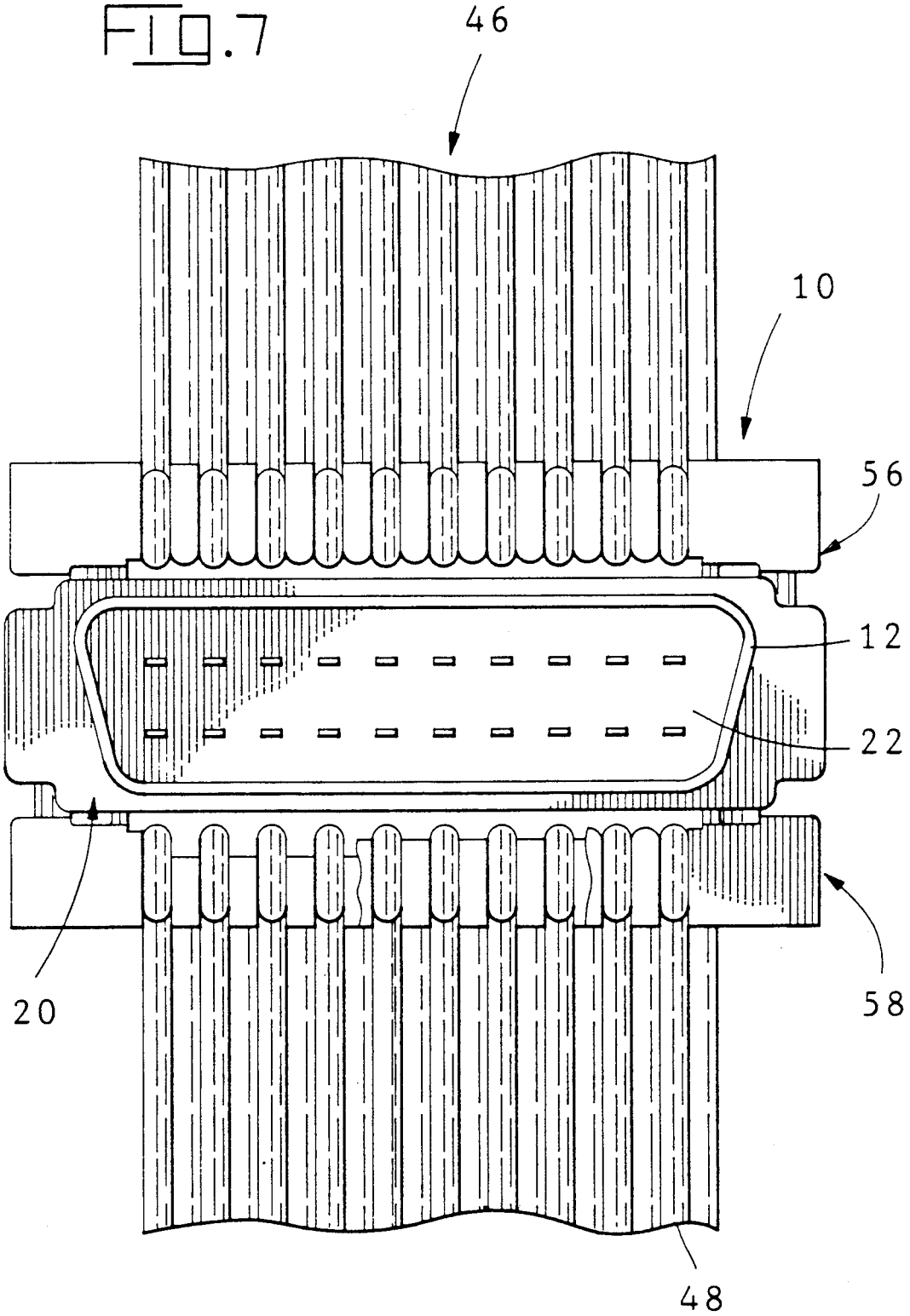
FIG. 7 is a top end view of the connector of FIG. 1 taken along lines 7—7.

FIG. 7 shows a series of connectors 10 terminated in a daisy chain configuration on a ribbon cable 46. The connectors are shown without backshells and backshell covers, but could have these features.

Figure 8:
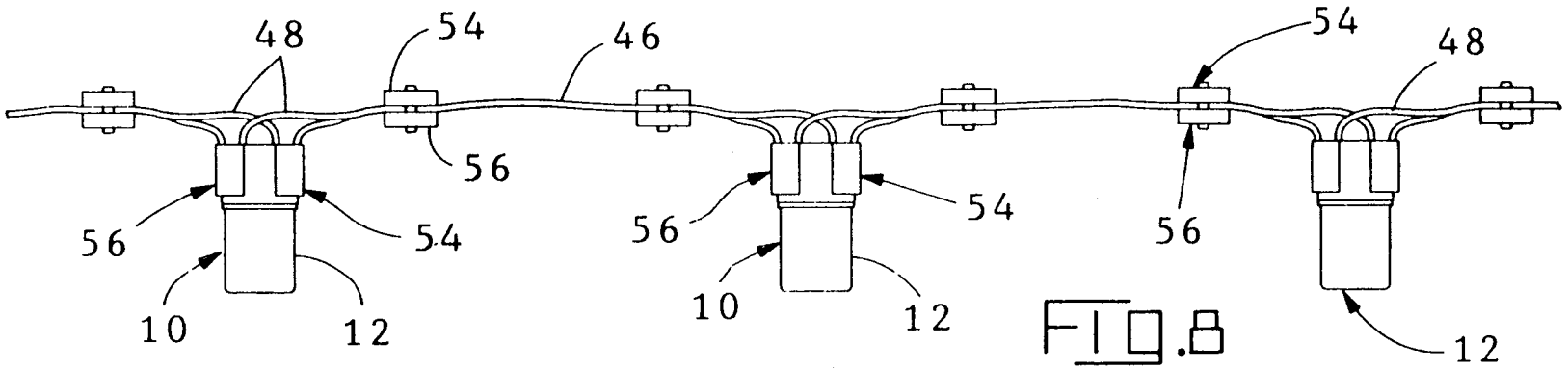
FIG. 8 shows a series of connectors, such as the connector in FIG. 1, terminated in a daisy chain configuration on a ribbon cable.
Figure 9:
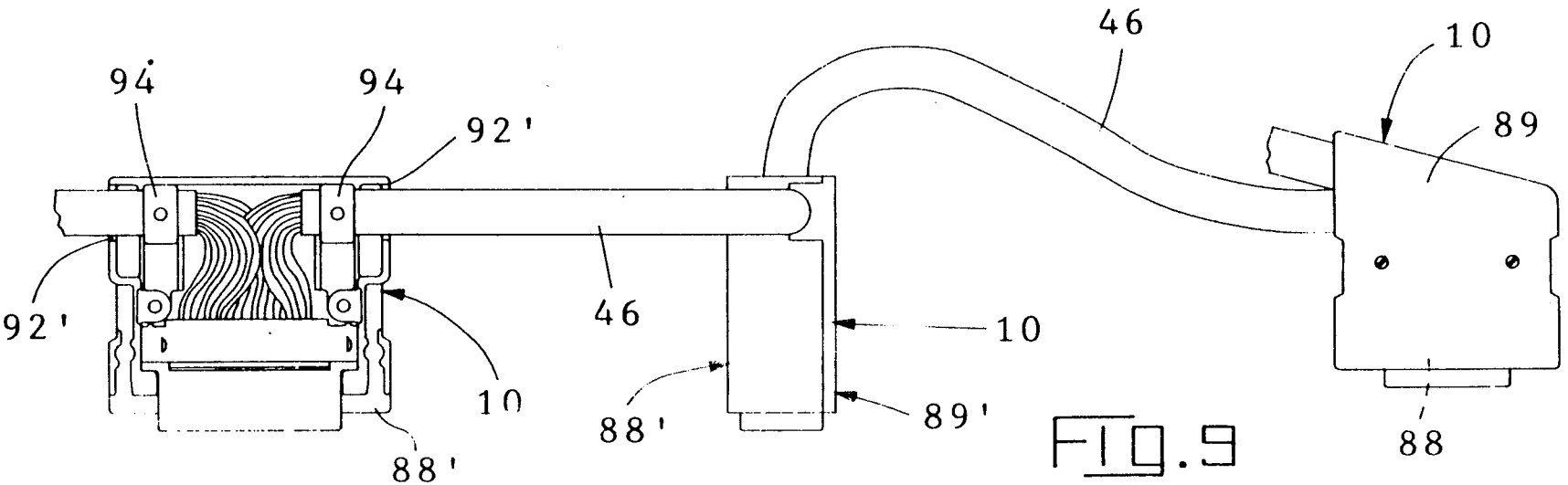
FIG. 9 is an alternate embodiment showing a series of connectors terminated on a round multiple conductor cable in a daisy chain configuration.
Figure 10:
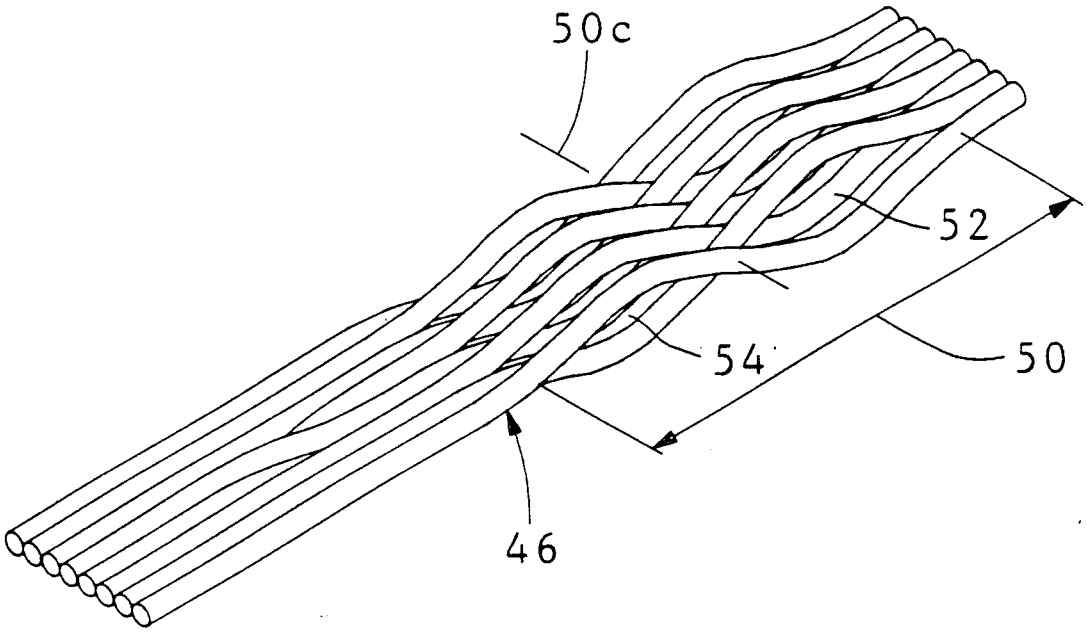
FIG. 10 is a perspective view of a split cable, similar to FIG. 2, having two conductors reversed or twisted in position and having two loops formed in the cable.
Figure 11:
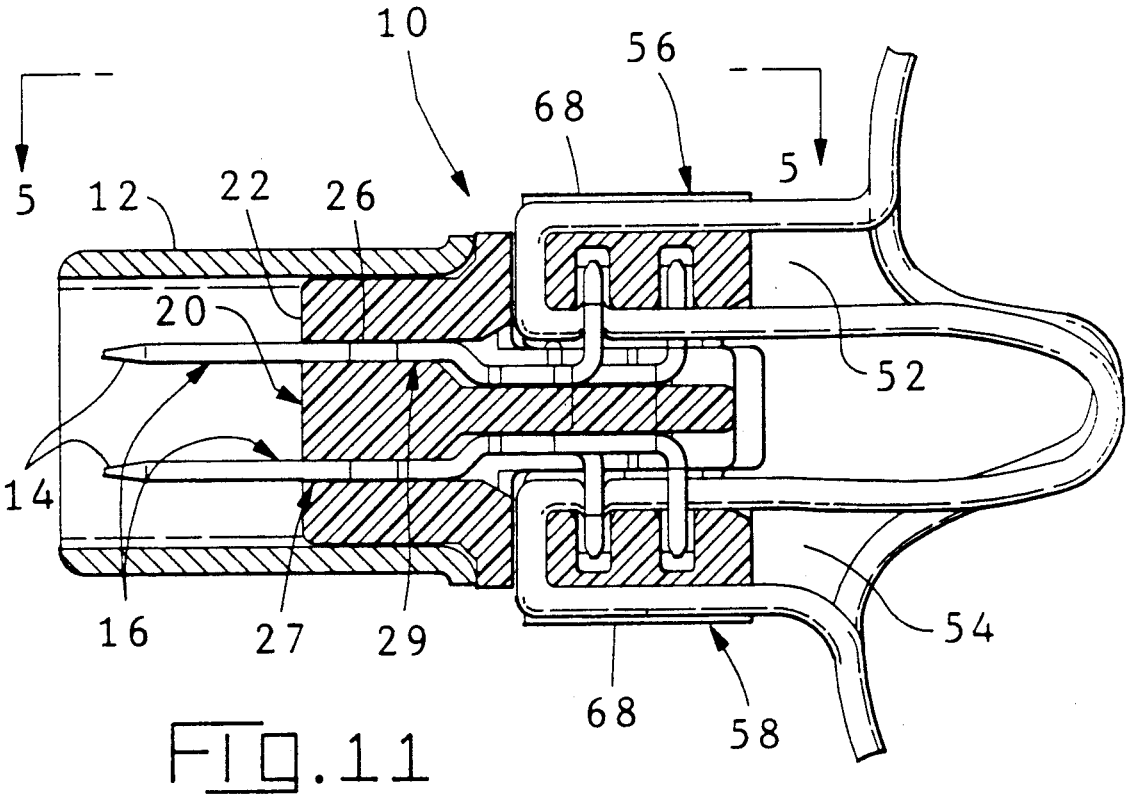
FIG. 11 is a sectional side view of a connector, similar to FIG. 4, showing a single conductor formed into both loops of the cable and terminated to two contacts in the connector.

FIG. 8 shows a series of connectors 10 terminated in a daisy chain configuration on a round cable 46. Housing 20 may be secured and partially enclosed in backshell members 88,90. Backshell members 88,90 may be electrically conductive with drawn shell 12 and shielding 49 as well as shielding on cable 46, if present, to provide a common ground therebetween. Backshells 88,90 may be as disclosed in U.S. Pat. No. 4,781,615 having a single cable exit 92 for the cable 46. Alternatively, there may be a dual cable exit 92' for conductors, as shown in backshell member 88',90' in FIG. 8. Strain relief is provided to the conductors proximate the cable exit, such as by strain relief means 94.

I claim:

1. An electrical connector assembly for terminating conductors of a multiconductor cable in a daisy chain configuration, comprising:

a dielectric housing having a mating face and an opposed rear face with a plurality of contact receiving passages disposed in two rows extending therebetween with first and second rows of contacts secured therein, said contacts having an axis, a mating portion proximate said mating face and a terminating portion extending beyond said rear face, said terminating portion formed to be an insulation displacing plate having a slot therein, said slot extending normal to the axis of said contacts with the insulation displacing plate in the first row of contacts extending in a first direction and the insulation displacing plate of the second row of contacts extending in a second direction, said second direction opposite to said first direction;

a pair of conductor terminating covers, each of said conductor terminating covers adapted to be received adjacent said rear face and to terminate conductors to the terminating portion of respective contacts of a row of contacts, each of said conductor terminating covers having means for securing said cover to said housing, said terminating covers defining a conductor receiving passage adjacent said rear face adapted to pass conductors between the rear face and a respective terminating cover;

a terminal support block extending from the rear face of said housing between the rows of contacts, a pair of spaced apertures in said terminal support block defining aperture walls, said terminating covers comprising spaced first leg means having first aperture means adjacent thereto on a first terminating cover, said first aperture means defining first wall means, spaced second legs means having second aperture means adjacent thereto on a second terminating cover, said second aperture means defining second wall means, said first leg means adapted to be received in said pair of spaced apertures at a predetermination position in an interference fit between a first portion of said first leg means and a first portion of said aperture walls, said second leg means adapted to be received in said pair of spaced apertures from an opposed direction from said first leg means, said second leg means adapted to be received in said pair of spaced apertures at a predetermined position in an interference fit between a first portion of said second leg means and a second portion of said aperture walls, said first leg means adapted to be secured in said spaced apertures at a termination position with said first leg means extending into said second aperture means in an interference fit between a second portion of said first leg means and said second wall means, said second leg means adapted to be secured in said apertures at a termination position with said second leg means extending into said first aperture means in an interference fit between a second portion of said second leg means and said first wall means, said second leg means adapted to be secured simultaneously with said first leg means, whereby when the first and second terminating covers terminate conductors to the terminating portion of contacts as they move from the pretermination position to the terminated position with the interference fit that secures the terminating covers in the terminated position being between a wall means and an area of the respective leg means not previously deformed by the interference fit that retains the terminating covers in the pretermination position.

2. An electrical connector assembly as recited in claim 1 wherein the conductor receiving passage is profiled to align conductors of the cable with the terminating portion of respective contacts.

3. An electrical connector assembly as recited in claim 2 wherein the surface of a conductor terminating cover is fluted to assist in positioning conductors of the cable at the same spacing as the respective contacts.

4. A method of terminating a connector having a housing and first and second rows of insulation displacement contacts to conductors of a multiple conductor cable at a mid-point thereof, said method comprising the steps of:

dividing the conductors of a multiple conductor cable into a preselected first group of conductors and a preselected second group of conductors:

forming the preselected second group of conductors to include at least one of the conductors included in the preselected first group of conductors;

contouring the first group of conductors into a first loop;

contouring the second group of conductors into a second loop;

terminating all of said first group of conductors to selective ones of said insulation displacement contact in said first row; and terminating all of said second group of conductors to selective ones of said insulation displacement contacts in said second row.

* * * * *